US005678941A

United States Patent [19]

Nakajima

[11] Patent Number: 5,678,941

[45] Date of Patent: Oct. 21, 1997

[54] LIQUID APPLICATOR

[75] Inventor: Nobuyuki Nakajima, Takasaki, Japan

[73] Assignee: Mitsubishi Pencil Co., Ltd., Tokyo, Japan

[21] Appl. No.: 508,208

[22] Filed: Jul. 27, 1995

[30] Foreign Application Priority Data

Aug. 1, 1994 [JP] Japan ..... 6-200233
Apr. 6, 1995 [JP] Japan ..... 7-108301

[51] Int. Cl.[6] ..... B43K 8/04

[52] U.S. Cl. ..... 401/205; 401/151; 401/202; 401/206; 401/245; 401/269

[58] Field of Search ..... 401/151, 186, 401/269, 206, 202, 245, 205

[56] References Cited

U.S. PATENT DOCUMENTS

| | | | |
|---|---|---|---|
| 675,699 | 6/1901 | Wirt | 401/245 |
| 978,419 | 12/1910 | Wirt | 401/245 |
| 1,079,228 | 11/1913 | Farmer | 401/245 |
| 3,075,229 | 1/1963 | Ruso | 401/186 |
| 3,129,452 | 4/1964 | Schwartzman | 401/206 |
| 3,331,094 | 7/1967 | Schwartzmann | 461/269 |

FOREIGN PATENT DOCUMENTS

| | | | |
|---|---|---|---|
| 5-31996 | 4/1993 | Japan . | |
| 5-305529 | 11/1993 | Japan . | |
| 245028 | 6/1947 | Switzerland | 401/202 |

*Primary Examiner*—Steven A. Bratlie
*Attorney, Agent, or Firm*—Armstrong, Westerman, Hattori, McLeland & Naughton

[57] ABSTRACT

A fluid applicator which makes application work easy because liquid splash outside the container body is prevented by opening the valve by removing the cap such that the liquid is supplied directly to the applicator member from the container body. The valve body incorporated in a sealed chamber is pressed against the shouldered seal portion to bring the sealed chamber into communication with the connecting passage such that the liquid discharged from the container body is allowed to flow into the sealed chamber through a hollow shaft member and is further led through a connecting passage into the applicator attachment hole to which the applicator member is attached.

13 Claims, 13 Drawing Sheets

LIQUID APPLICATOR

BACKGROUND OF THE INVENTION

The present invention relates to a liquid applicator and more particularly to a liquid applicator which is constructed to directly supply the liquid charged in an elastic container to an applicator member attached to the tip end of the liquid applicator.

Conventionally known is a liquid applicator having a container formed with a liquid discharge vent at the tip end thereof where a valve body is provided to open and close the liquid discharge vent such that the liquid charged in the container is caused to flow out through the discharge vent at the time the valve is open for application purposes. There is known another liquid applicator further having an applicator member into which the liquid discharged from such discharge vent is allowed directly to soak into the applicator member for the application of the liquid.

Such applicator includes a mending liquid applicator disclosed in Japanese Pat. Appln. Kokai Pub. No. 5-305529 and Japanese U.M. Appln. Kokai Pub. No. 5-31996 in which the applicator section at the tip end thereof is pressed to open the valve so that the liquid therein is discharged; or various types of applicators with liquids including ink, paint, toilet lotion, mending liquid, shoe polish, etc. being charged therein.

Of such prior art applicators, applicator 1 charged with liquids such as shoe polish or the like will be described referring to FIG. 25 and FIG. 26 hereinafter.

First of all, container 2 formed of an elastic material is charged with liquid such as shoe polish. To the tip end thereof is attached a forward member 4 having a liquid discharge vent 3 in the center thereof. Ring-shaped applicator member 5 of sponge is attached to the outside of the forward member 4. When the applicator is not in use, cap 6 is screwed onto the forward member 4 of the container 2 such that seal rod 7 centrally projecting from the inside of the cap 6 is inserted into the center portion of applicator member 5 to block the liquid discharge vent 3 formed in the forward member 4.

In this way, cap 6 is attached thereon while applicator 1 is not in use such that the seal rod 7 of the cap 6 blocks the liquid discharge vent 3 with the result that the liquid will not be discharged out of the discharge vent 3. While in use, on the other hand, cap 6 is removed such that the inside liquid is squeezed out of the discharge vent 3 by pressing container 2 to soak into the applicator member 5 for application work.

However, the technical problem is observed with the aforementioned prior art applicator 1; that is, it has the liquid discharge vent 3 which directly opens outwardly with the result that low viscosity liquid charged inside the container 2 can splash out when cap 6 is removed for use by jerking the container 2 or the liquid can shoot out to stain things therearound when the container 1 is pressed.

In using this conventional type of applicator 1, therefore, cap 6 is first removed to press applicator member 5 onto an object to which the liquid is to be applied. Then, container 2 is pressed to force out the liquid therein such that the forced out liquid is prevented from leaking outside by being blocked by applicator member 5 of sponge or similar and the object to which the liquid is to be applied. It is also required that the liquid is carefully applied by allowing the liquid to soak into applicator member 5 while seeing to it that there is no leak or drip of the liquid. This procedure, however, makes the application work troublesome and there has been a problem in finding a liquid applicator easier to handle.

Seal rod 7 of cap 6 is designed to block liquid discharge vent 3 in container 2 while not in use, making it impossible to provide the applicator member 5 covering the liquid discharge vent 3 with the result that low viscosity liquid is liable to splash outside. However, if high viscosity liquid is used to prevent such liquid splash outside the applicator 1, even application of liquid is difficult in addition to the problem of increased liquid consumption. Moreover, use of high viscosity liquid is impossible for some field of application.

Further in the aforementioned conventional applicator 1, it is required that the applicator member 5 attached around the liquid discharge vent 3 be made of a sponge material which is excellent in liquid absorbing capability such that there is no leak of liquid discharged out of the liquid discharge vent 3. This means that a brush, which is poor in liquid absorbing capability, is not suited for this purpose. Even if a sponge is used for the applicator member 5, it ages with the passage of time to such an extent that fragments of damaged sponge caused by repeated use can stick to the object to which the liquid is to be applied, thereby marring the finished surface thereof.

On the other hand, applicators such as disclosed in Japanese Pat. Appln. Kokai Pub. No. 5-305529 and Japanese U.M. Appln. Kokai Pub. No. 5-31996 have tip end application members directly pressed to open the valve such that the liquid is discharged though the majority of the applicator members are formed of felt which is susceptible to aging with the passage of time with the result that repeated use thereof causes broken fragments of damaged applicator portion due to aging can mar the finishing surface of the object which the liquid is to be applied or that the diameter or the width of the tip end of the applicator member may vary to allow unnecessary application of the liquid. Such applicator has the liquid discharged particularly from around the applicator member with the result that the liquid can stick to the object to which the liquid is to be applied before the applicator member absorbs the liquid, thus causing uneven application of the liquid.

SUMMARY OF THE INVENTION

The present invention is made to solve the aforementioned problems of the conventional applicators and has its objects that by removing the cap of the applicator to open the valve the liquid is directly supplied from the container to the object to which the liquid is to be applied that facility of the application work is accomplished while splashing out of the liquid is prevented and that the liquid applicator with assurance of constantly even liquid application is provided.

In order to accomplish the above objects, the present invention essentially provides a liquid applicator which includes a container body made of an elastic resin material, the container body being charged with a predetermined liquid therein; an intermediate shaft member hermetically attached to the container body at an open end thereof to close discharge vent formed therein, the intermediate shaft member further having a hollow shaft member in communication with the liquid discharge vent and integrally projecting outwardly therefrom; a forward shaft member press fitted to the intermediate shaft member and having a first communication passage into which the hollow shaft member is press fitted, the communication passage having a shouldered seal portion at a forward end thereof, the forward shaft member further having an applicator attachment hole which opens forwardly and a connecting passage to provide communication between the first communication passage and the applicator attachment hole; a valve body incorporated into the first communication passage to be normally urged against the shouldered seal portion to define a seal chamber separated from outside; and an applicator member fixedly inserted into the applicator attachment hole; whereby the valve body incorporated in the first communication is urged against the shouldered seal portion to bring the sealed chamber into communication with the connecting passage such that the liquid discharged from the container body is allowed to flow into the sealed chamber through the hollow shaft member and is further led through the first connecting passage into the applicator attachment hole.

DETAILED DESCRIPTION OF THE EMBODIMENTS

Figure 1:
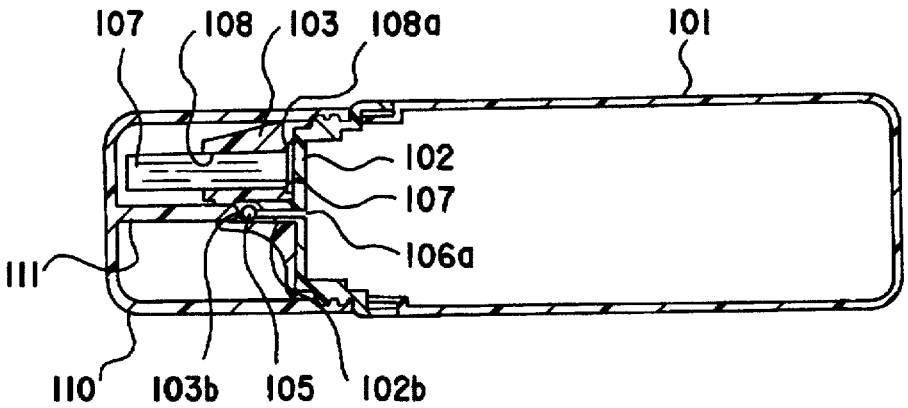
FIG. 1 is a vertical sectional view of the principal portion of the first embodiment of the liquid applicator according to the present invention when it is not in use.
Figure 2:
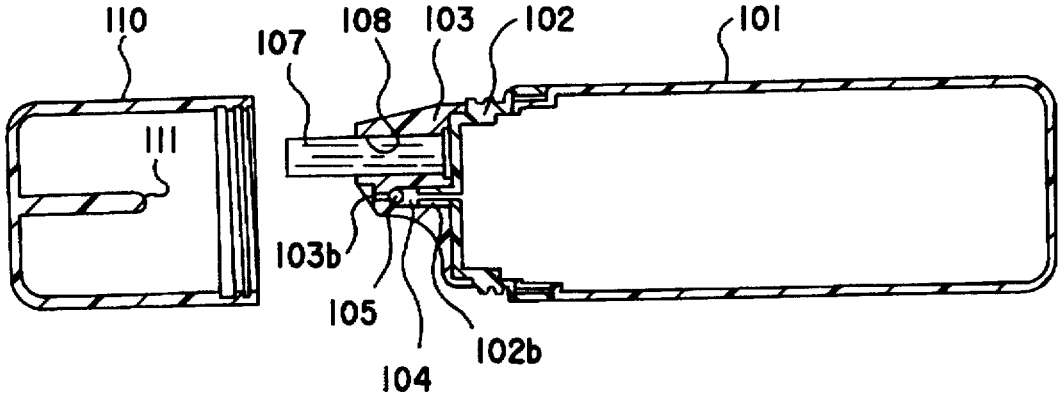
FIG. 2 is a vertical sectional view of the principal portion of FIG. 1 with the cap being removed when it is in use.

Embodiments of the present invention will be explained with reference to the drawings.

In the FIG. 1 through 4, the container 101, made of an elastic material such as resin, is charged with a predetermined fluid before the intermediate shaft member 102 having a liquid discharge vent 102*a* centrally formed is screwed or fused onto the longitudinal end opening of container 101. Further, forward shaft member 103 is press fit into or fused onto the tip end of the intermediate shaft member 102.

Outside the liquid discharge vent 102*a* formed in the intermediate shaft member 102, hollow shaft member 102*b* communicating with the liquid discharge vent 102*a* is integrally formed to project therefrom. When the forward shaft member 103 is engaged onto the intermediate shaft member 102, the hollow shaft 102*b* of the intermediate member 102 is press fit into communication passage 103*a* of the forward shaft member 103, thus defining seal chamber 104 between the tip end of hollow shaft 102*b* and communication passage 103*a* of forward shaft member 103.

Valve body 105 such as a check ball is incorporated together with resilient body 106 such as a valve spring at the time of engaging the forward shaft member 103 onto intermediate shaft member 102. The valve body 105 incorporated into seal chamber 104 is pressed against the shouldered small diameter seal portion 103*b* formed within the communication passage 103*a* to close the communication passage 103*a* such that the outside and inside of the container 101 is separated.

In this connection, the face on the valve side of the shouldered small diameter seal portion 103*b* may be formed perpendicular, tapered or spherical to follow the contour of the valve body 105.

Laterally off the centrally formed communication passage 103*a* in the forward shaft member 103 is formed applicator attachment hole 108 for applicator body into which applicator member 107 made of a material such as felt, sponge or brush is engaged. Counter-bored portion 108*a* is formed at the root portion of the applicator attachment hole 108 to engage flange portion 107*a* formed at the base of applicator member 107. Thus, when the applicator member 107 is fit into the attachment hole 108 in the forward shaft member 103, the flange portion 107*a* of the applicator member 107 is engaged with the counter-bored portion 108*a* before the forward shaft member 103 is capped onto intermediate shaft member 102 such that the rearward end face of applicator member 107 is held by intermediate shaft member 102.

Further, when the forward shaft member 103 is attached intermediate shaft member 102, communication passage 103*c* is defined which communicates from sealed chamber 104 along hollow shaft 102*b* to counter-bored portion 108*a* of the attachment hole 108. When valve body 105 incorporated into sealed chamber 104 is pressed against shouldered seal portion 103*b* formed in communication passage 103*a* of forward shaft 103 to block, the liquid charged in container 101 flows through hollow shaft 102*b* to sealed chamber 104 before it further flows from sealed chamber 104 through connecting passage 103c formed along hollow shaft 102b to the counter-bored portion 108a of the attachment hole 108.

On the other hand, cap 110 to be attached to the forward portion of the container 101 is screwed onto the tapped portion 109 formed in the outside periphery of intermediate member 102. Inside the cap 110 is centrally formed valve pushing rod 111 having a predetermined length to project into communication passage 103a in the forward shaft member 103. Therefore, when cap 110 is screwed onto the taped portion 109 of intermediate portion 102, valve pushing rod 111 of the cap 110 is inserted into communication passage 103a in the forward shaft member 103. Therefore, valve body 105 closing communication passage 103a is urged back against resilient member 106 to be pressed against tapered portion 102c formed in the tip of hollow shaft 102b with the result that the liquid flowing into the sealed chamber 104 through hollow shaft 102b is blocked. The valve side hem of the tapered portion 102c may be circular, rounded or shaped anyway to follow the shape of the valve body 105.

Due to the aforementioned construction, cap 110 is kept attached to the tip end of container 110 while the applicator is not in use, in custody or during transit. In this condition, valve body 105 incorporated in the sealed chamber 104 is pressed against the tip end of hollow shaft 102b by valve pushing rod 111 such that fluid will not flow into the sealed chamber 104 blocked thereby. Therefore, even if container 101 is pressed or the inside pressure of container 101 increases due to the rise of ambient temperature, the fluid will not leak outside the sealed chamber 104.

When cap 110 is removed from the tip end of container body 101 to use the applicator, the pressing of valve body 105 by valve pushing rod 111 is removed such that valve body 105 is pressed against shouldered seal portion 103b formed in communication passage 103a of forward shaft member 103 to separate the outside and the inside of the sealed chamber 104. As a result, the liquid in the sealed chamber 104 is prevented from leaking outside while the fluid led from container 101 into the sealed chamber 104 flows through connecting passage 103c into counter-bored portion 108a of applicator attachment hole 108. Therefore, the fluid having soaked into the applicator member 107 is applied to a desired surface of the object to be applied by holding container 101 to press the applicator member 107 thereto and is continuously applied by keeping the container 101 pressed.

In this circumstance, valve body 105 incorporated into the sealed chamber 104 in this invention shall not be limited to a spherical ball but may be of configuration of a piston. It is preferred that the metal valve body is formed of metal. In this case, rust-resisting stainless steel is preferred. The valve body 105 may be of synthetic resin material including PP (polypropylene), HDPE (high density polyethylen), nylon, POM (polyathetal). Resilient member 106 such as the valve spring which presses the valve is in the form of a coil spring though the material thereof may be of rust-resisting stainless steel is preferred while synthetic resin is acceptable.

While the fluid charged in container body 101 is allowed to flow through hollow shaft 102b to the sealed chamber 104 before the fluid is further admitted through communication passage 103c defined along the face of the hollow shaft 102b into the counter-bored portion 108a of attachment hole 108, the communication passage 103c may be formed to communicate to a position close to the tip end of the applicator member 107 inserted into the attachment hole 108 of the forward shaft member 103. In the instant embodiment, however, the fluid will soak into the whole of applicator member 107 to make the application area sufficient at one discharge stroke while the applicator member provides a sufficient volume to retain a large mount of discharged liquid therein, thus avoiding the dripping thereof. Therefore, extra discharge liquid resulting from excessive pressing of container body 101 will retract back into container 101 from applicator member 107 by removing the pressing force exerted on container 101.

Figure 5:
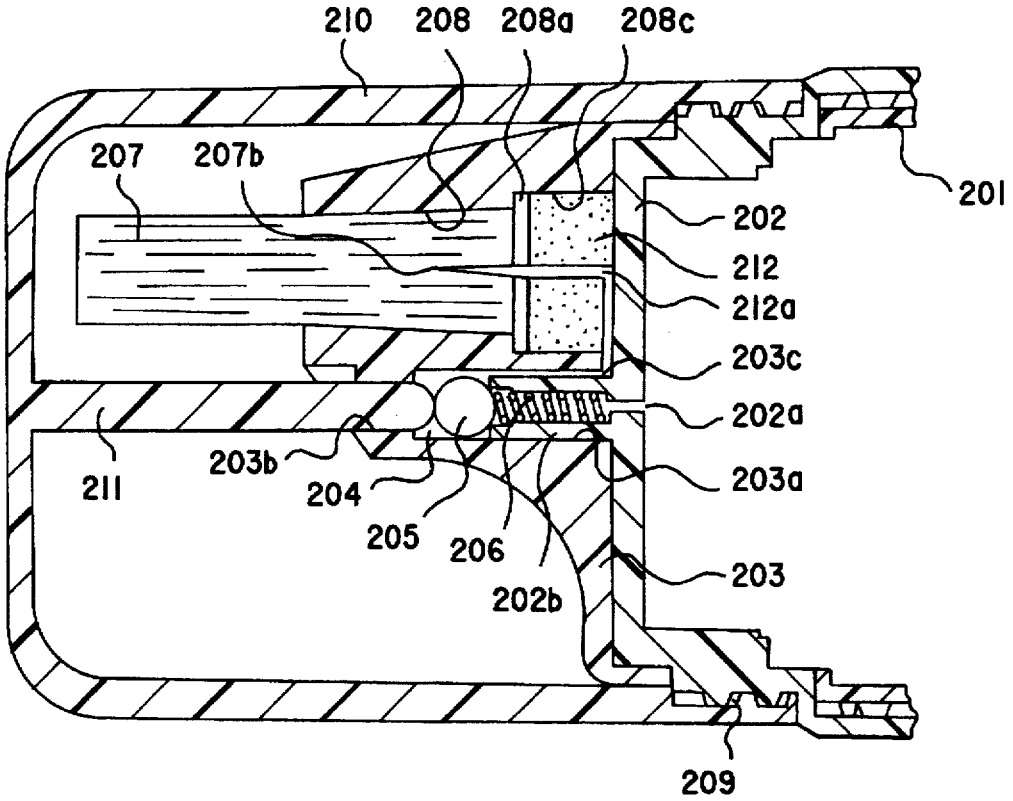
FIG. 5 is a vertical sectional view of the principal portion of the second embodiment of liquid applicator according to the present invention when it is not in use.
Figure 6:
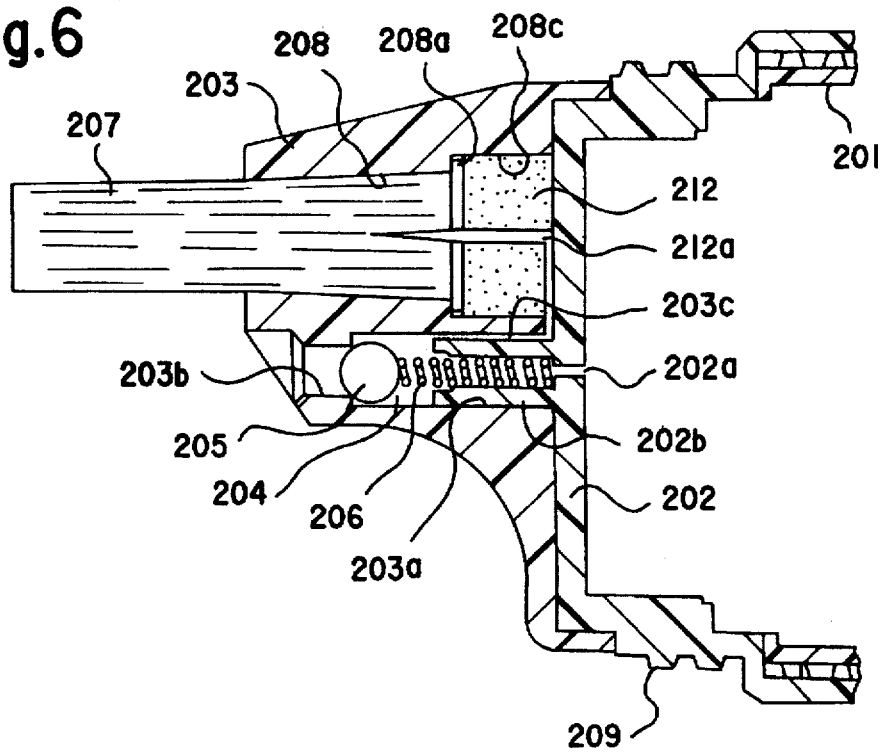
FIG. 6 is a vertical sectional view of the principal portion thereof in use with the cap being removed.

FIG. 5 is a vertical sectional view of the principal portion of the second embodiment of the fluid applicator according to the present invention. FIG. 6 is a vertical sectional view of the state in which the cap 210 is removed for use of the fluid application of FIG. 5. In both figures, the similar numerals are allotted to the similar members to the first embodiment.

In the second embodiment of the present invention, recess 208c extending from the counter-bored portion 208a in forward shaft member 203 is formed to deepen the counter-board portion 208a. Into the recessed portion 208c is inserted block plug 212 having second connecting passage 212a which communicates communication passage 203c in forward shaft member 203. Further, receiving hole 207b having a predetermined length is formed in the base portion of applicator member 207 to communicate with the second communication passage 212a in the block plug 212 to facilitate the introduction of the fluid into the applicator member 207.

In a case where the cap 210 of the applicator of the second embodiment is removed to use the applicator, the liquid discharged from container 201 into the sealed chamber 204 is led from connecting passage 203c of forward shaft member 203 through second communication passage 212a in the block plug 212 inserted into recessed portion 208c before the fluid is further admitted into the introduction hole 207b substantially centrally formed in application member 207 to soak into the application member 207. As a result, the fluid is easily absorbed into applicator member 207 without the concern of liquid dripping to assure good application performance.

Figure 7:
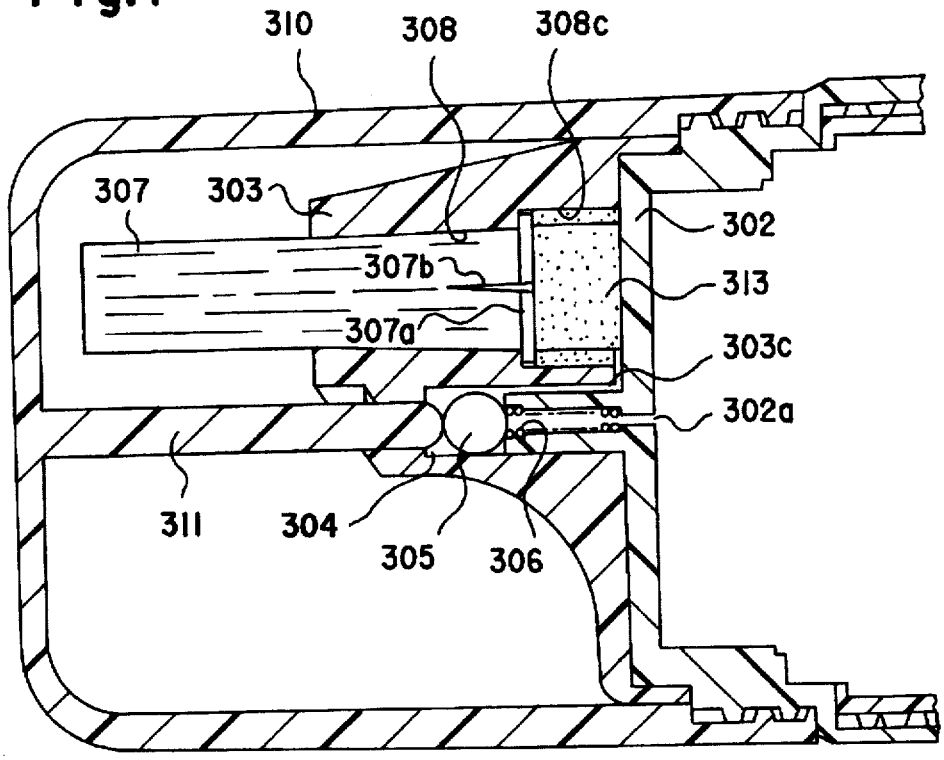
FIG. 7 is a vertical sectional view of the principal portion of the third embodiment of the liquid applicator according to the present invention when not in use.
Figure 8:
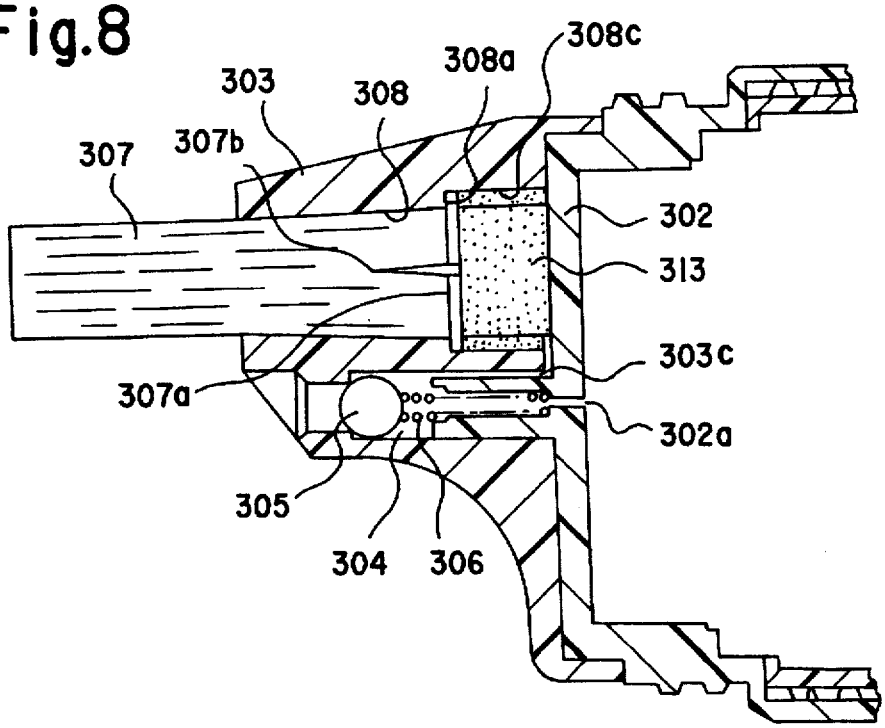
FIG. 8 is a vertical sectional view of the principal portion thereof in use with the cap shown in FIG. 7 being removed.

FIG. 7 is a vertical sectional view of the principal portion not in use of the third embodiment of the fluid applicator of the present invention whereas FIG. 8 is a vertical sectional view of the principal portion in use shown in FIG. 7 wherein similar numerals are used for similar members which are common to those in the first and second embodiments and explanation therefor is omitted.

In the third embodiment of the present invention, recess 308c extending from the counter-bored portion 308a is formed in forward shaft member 303 to deepen said counter-bored portion 308a in which flange 307a of applicator member 307 is inserted. Liquid absorbing member 313 is fitted in the recessed portion 308c such as a sponge which has excellent liquid retaining capability for the fluid. Thus structured, the liquid supplied from container 301 through the sealed chamber 304 to recess 308c is absorbed in quantity into liquid absorber 313 such that one grip of container 301 assures the advantage that a large area is subjected to application work without intermission.

Figure 9:
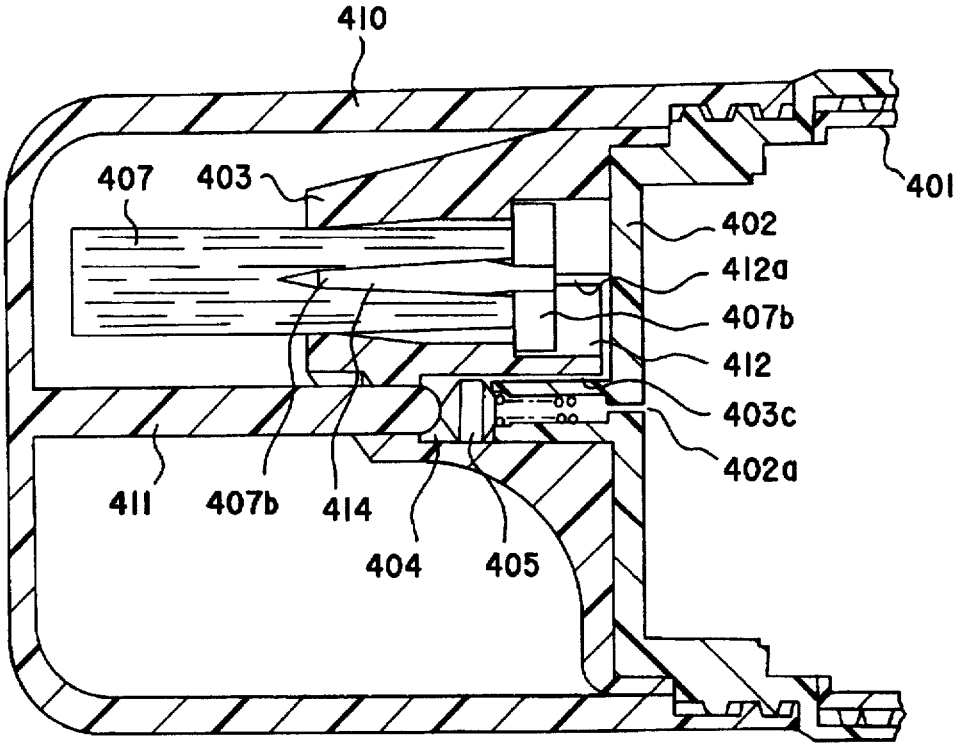
FIG. 9 is a vertical sectional view of the principal portion of the forth embodiment of the liquid applicator according to the present invention when it is not in use.
Figure 10:
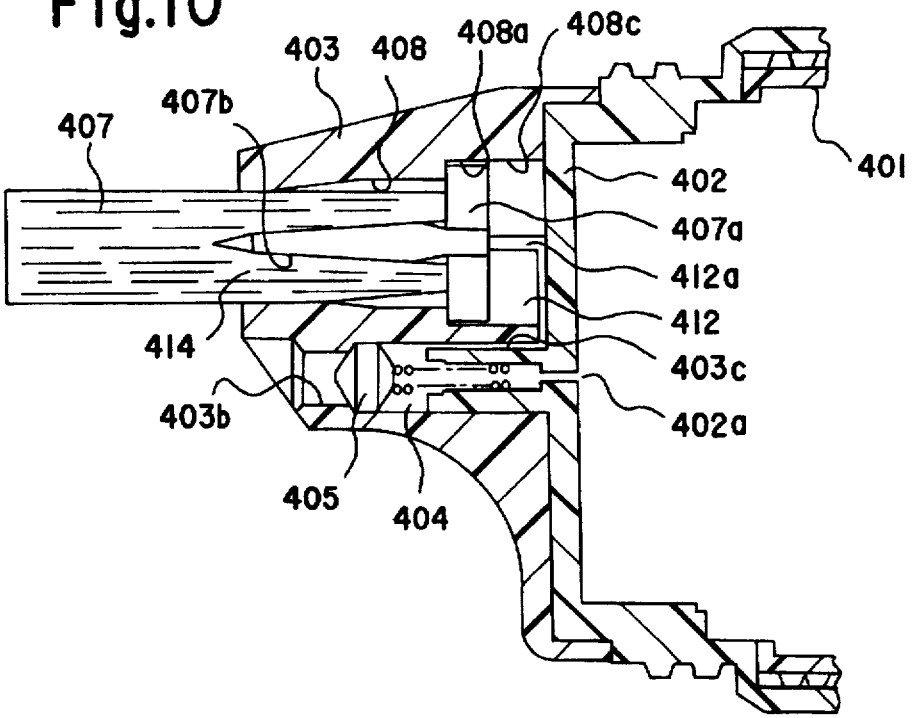
FIG. 10 is a vertical sectional view of the principal portion thereof with the cap being removed to show the state thereof when it is in use.

FIG. 9 is a vertical sectional view of the principal portion not in use of the forth embodiment of the fluid applicator according to the present invention. FIG. 10 shows a vertical sectional view of the principal portion thereof in use with the cap 410 being removed. In the figures, similar numbers are accorded to similar members which are common to the first and second embodiments while the explanation therefor will be omitted.

When a brush into which fibers are bundled or sintered together or a brush which is implanted with fibers by use of threads is used, the problem with it is that the fiber density is not sufficient and is susceptible to liquid dripping due to its poor liquid retaining capability. The fourth embodiment according to the present invention is constructed such that recessed portion 408c is formed in forward shaft member 403 to extend from counter-bored portion 408a in a deepened form thereof for receiving flange portion 407a of applicator member 407 therein. In the recessed portion 408c is an engaged block plug 412 which is formed with second connecting passage 412a to communicate with first connecting passage 403c in forward shaft member 403. The applicator member 407 is formed with introduction hole 407b longitudinally over a predetermined distance from the base thereof to communicate with second communication passage 412a in block plug 412. Into the introduction hole 407b is engaged liquid absorbing member 414 of sponge having an excellent liquid retaining capability. The thus constructed applicator member 407 assures excellent liquid retaining capability for the fluid and provides a brush which well prevents the fluid from dripping.

Figure 11:
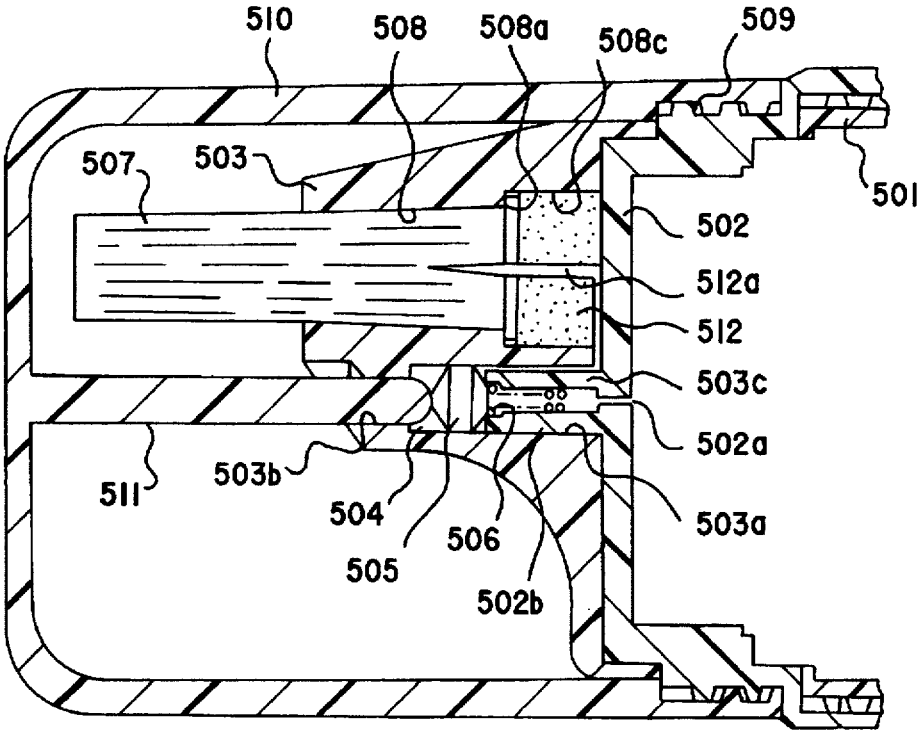
FIG. 11 is a vertical sectional view of the principal portion of the fifth embodiment of the liquid applicator according to the present invention to show the state thereof when not in use.
Figure 12:
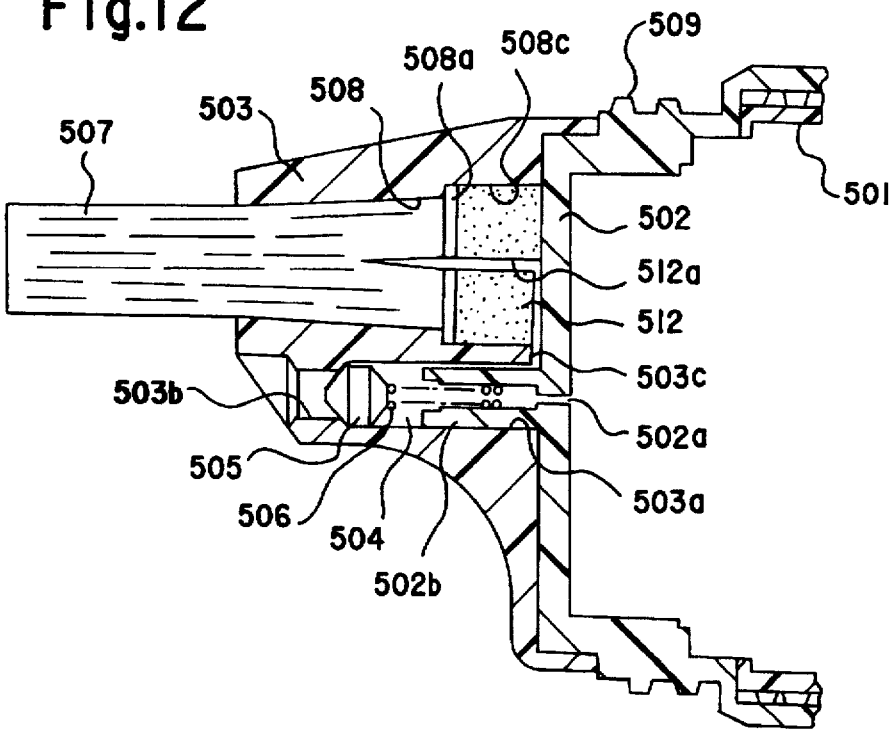
FIG. 12 is a vertical sectional view of the principal portion thereof in use with the cap being removed.

FIG. 11 is a vertical sectional view of the principal portion not in use of the fifth embodiment of the fluid applicator according to the present invention and FIG. 12 is vertical sectional view in use thereof with the cap shown in FIG. 11 being removed. In the figures, similar numbers are accorded to similar members which are common to the first and second embodiments with explanation therefor being omitted.

The fifth embodiment of the present invention is basically the same in construction as the second embodiment except for the fact that valve body 505 introduced in the sealed chamber 504 defined by the tip end of hollow shaft 502b of intermediate shaft member 502 and communication passage 503a in the forward shaft member 503 is in the form of a piston. The valve body 505 is formed into a semi-spherical or conical configuration. When cap 510 is attached thereon in disuse, valve pushing rod 511 is inserted into communication passage 503a of forward shaft member 503 to push valve 505 such that the valve 515 resting within communication passage 503a is pressed against tapered portion 502c at the tip end of hollow shaft 502b to prevent the fluid from flowing into seal shaft 504 through hollow shaft 502b from container 501.

When cap 510 is removed from the tip end of container 501 to use the applicator, the pressing of valve body 505 by valve pushing rod 511 is removed as shown in FIG. 12. As a result, valve body 505 is pressed by resilient member 506 against shouldered seal portion 503b formed in the communication chamber 503a of forward shaft member 503 to separate the sealed chamber 504 and the outside thereof, thereby preventing the fluid within the sealed chamber 504 from leaking outside, while the fluid discharged from container 501 into the sealed chamber 504 is led through communication passage 503c to second communication passage 512a in block plug 512 engaged in recessed portion 508c where the fluid flows into introduction hole 507b substantially centrally formed in applicator member 507 to soak into the whole thereof.

Figure 13:
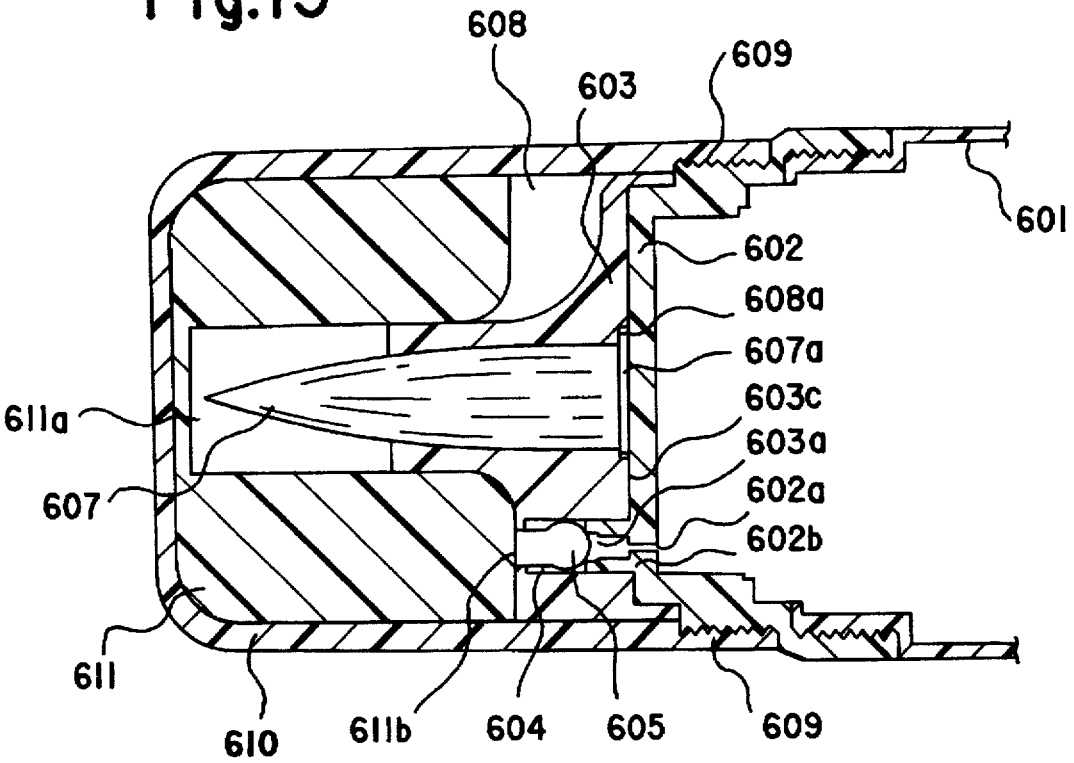
FIG. 13 is a vertical sectional view of the principal portion of the sixth embodiment of the liquid applicator according to the present invention while not in use.
Figure 14:
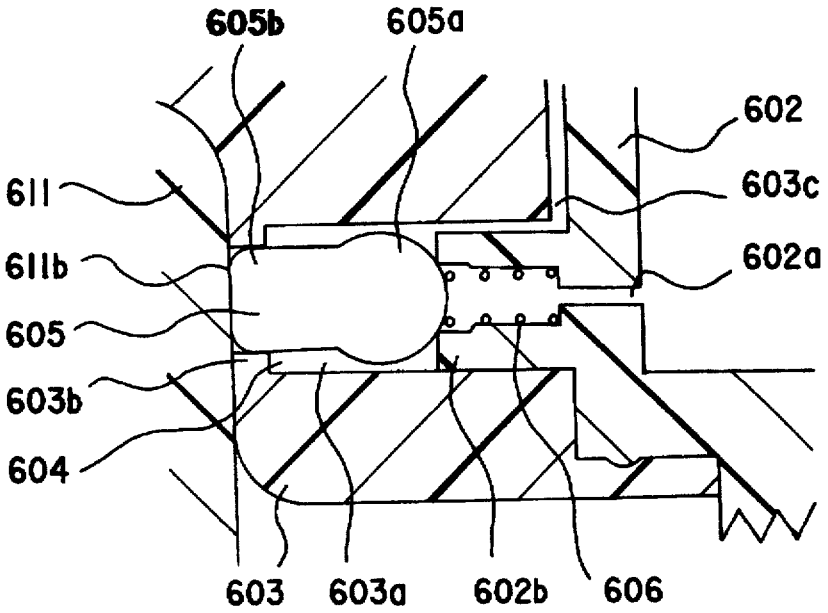
FIG. 14 is an enlarged vertical sectional view of FIG. 13.
Figure 15:
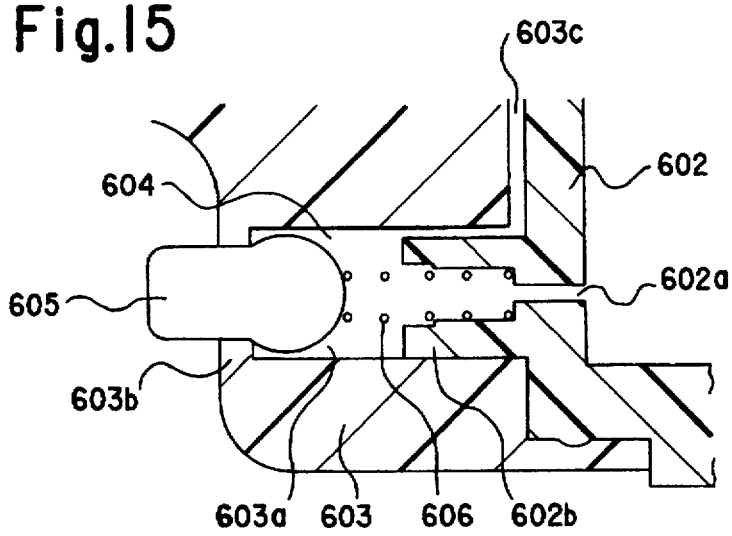
FIG. 15 is an enlarged vertical sectional view of FIG. 14 with the cap being removed.

FIG. 13 is a vertical sectional view of the principal portion of the sixth embodiment of the liquid applicator according to the present invention while not in use; FIG. 14 is an enlarged sectional view of the principal portion of FIG. 13; and FIG. 15 is an enlarged view of the principal portion of FIG. 14 while not in use, when the cap 610 is removed.

In the drawings, container body 601 is made of an elastic material like a synthetic resin or the like. After the container body 601 is charged with a predetermined liquid, intermediate shaft member 602 having a liquid discharge vent 602a formed off center or in a radially outward portion thereof is hermetically screwed, fused or engaged to the forward open end of container body 601 while the forward shaft member 603 is press fit or fused onto the forward end of the intermediate shaft member 602.

Outside the liquid discharge vent 602a formed in the intermediate shaft member 602 is formed hollow shaft member 602b integrally therewith. When the forward shaft member 603 is engaged on the intermediate shaft member 602, the hollow shaft member 602b of intermediate shaft member 602 is press fit into communication passage 603a of the forward shaft member 603 to define the sealed chamber 604 between the tip end of the hollow shaft member 602b and communication passage 603a of forward shaft member 603.

When the forward shaft member 603 is engaged on the intermediate shaft member 602, valve body 605 composed of spherical portion 605a and rod portion 605b is incorporated into the sealed chamber 604 together with resilient member 606 in the form of a valve spring. The valve body 605 incorporated into the sealed chamber 604 is pressed against small diameter shouldered seal portion 603b formed in communication passage 603a to provide communication between the liquid discharge vent 602a and connecting passage 603c which is to be described later.

In this connection, the valve side of the shouldered seal portion may be 603b rectangular, tapered, or shaped to follow the contour of the valve body.

Substantially centrally in the forward shaft member 603 is bored applicator attachment hole 608 to receive applicator member 607 composed of felt, sponge or a brush. The base of the applicator member 607 has a flange portion 607a which engages the counter-bored portion 608a formed at the rearward end of attachment hole 608.

When applicator member 607 is engaged in the attachment hole 608 in the forward shaft member 603, the flange portion 607a of applicator member 607 engages counter-bored portion 608a. In this condition, forward shaft member 603 is engaged onto intermediate shaft member 603 such that applicator member 607 is secured by forward shaft member 603 and intermediate shaft member 602.

By engaging the forward shaft member 603 onto intermediate shaft member 602, connecting passage 603c is defined to provide communication from the sealed chamber 604 along the side of hollow shaft 602b projecting from intermediate shaft member 602 to counter-bored portion 608a in attachment hole 608. Valve body 605 incorporated in the communication passage 603a is pressed against shouldered seal portion 603b to define the sealed chamber 604 in forward shaft member 603, thus opening the communication passage 603a (the state in which liquid discharge vent 602a and communication passage 603c are in communication with each other). In this state, the liquid charged in container 601 is discharged through hollow shaft 602b to the sealed chamber 604, where the fluid further continues to flow through connecting passage 603c defined along hollow shaft into counter-bored portion 608a of attachment hole 608.

With communication passage being kept open, rod portion 605b is caused to project outside intermediate shaft member 602 as shown in FIG. 15.

On the other hand, cap 610 to be attached to the forward portion of the container body 601 is screwed onto tapped portion 609 formed on the outer periphery of intermediate shaft member 602 while valve operating portion 611 having a central recess therein to receive applicator member 607 is fit inside the cap 610.

When cap 610 is screwed onto tapped portion 609 of intermediate shaft member 602, valve operating portion 611 of cap 610 receives applicator member 607 in the central recess 611*a* while rearward end 611*b* of valve operating portion 611 presses rod portion 605*b* of valve body 605 so far having kept communication passage 604*a* open to push back the valve body 605 against resilient body 606.

When cap 610 is screwed onto tapped portion 609 of intermediate shaft member 602, rearward end face 611*b* of valve operating portion 611 continues to contact and keep pressing rod portion 605*b* of valve body 605 since valve operating portion 611 is ring-shaped.

Valve body 605 is eventually pressed against the tip end of hollow shaft 602*b* to block the flow of the fluid from hollow shaft 602*b* into the sealed chamber 604.

As explained in the foregoing, cap 610 is attached onto the forward end of container 601 while not in use, in custody or during transit, valve body 605 incorporated in communication passage 603*a* is pressed against the tip end of hollow shaft 602*b* to prevent the fluid from flowing therein.

Therefore, the pressure on container body 601 or the increased inside pressure due to the rise of the ambient temperature within container 601 will not lead to leak of the fluid into communication passage 603*a*.

When cap 610 is removed from the tip end of container 601 to use the applicator, the pressing on valve body 605 by valve operating portion 611 is removed such that valve body 605 is now pressed against shouldered seal portion 603*b* of forward shaft member 603 by resilient member 606.

Therefore, the fluid flowing into the sealed chamber 604 from container body 601 is led through connecting passage 603*c* to counter-bored portion 608*a* of attachment hole 608.

Therefore, the fluid which has soaked into applicator member 607 is subjected to application work by gripping container body 601 to press applicator member 607 against a desired object surface and continued pressing of container body 601 allows application without intermission.

Moreover, applicator member 607 is centrally attached, thereby facilitating hand-writing work to user's purposes.

In this connection, it is to be noted in the present invention that valve body 605 incorporated within the sealed chamber 604 shall not be limited to the configuration shown in the aforementioned embodiments and may be in the form of a piston. The material of valve body 605 may be of synthetic resin or metal, in which valve body 605 is preferred to be of rust-proof stainless steel.

While connecting passage 603*c* is made to provide a passage for the fluid charged in container body 601 which has been discharged therefrom to flow through hollow shaft 602*b* and sealed chamber 604 into counter-bored portion 608*a* of the applicator attachment hole 608, such connecting passage 603*c* may be formed to be led to a position close to the tip end of the applicator member 607 secured in applicator attachment hole 608 in forward shaft portion 603. Opposed to this modification, however, the aforementioned embodiment assures that the liquid having soaked into the whole applicator member 607 makes larger an area to be applied with the fluid in one application stroke while making the liquid retaining capacity larger to prevent the liquid from dripping outside even if a large quantity of liquid is discharged at one stroke. Therefore, extra liquid discharged toward applicator member 607 due to excessive pressure on container 601 when the pressure on container 601 is removed.

Further, while the cap is constructed to be attached onto the intermediate shaft member, the cap may attached to the tip end of the container body.

Figure 16:
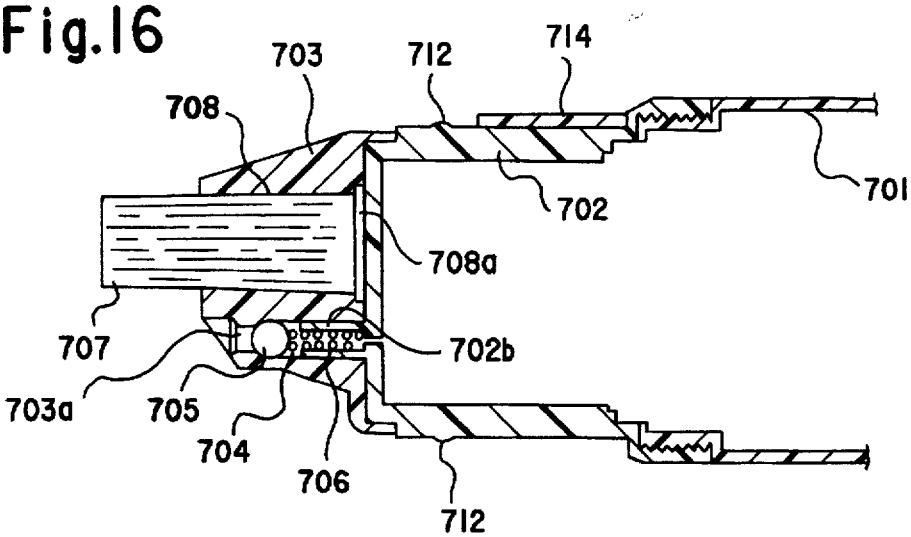
FIG. 16 is a vertical sectional view of the seventh embodiment of the liquid applicator according to the present invention with the cap being removed while in use.
Figure 17:
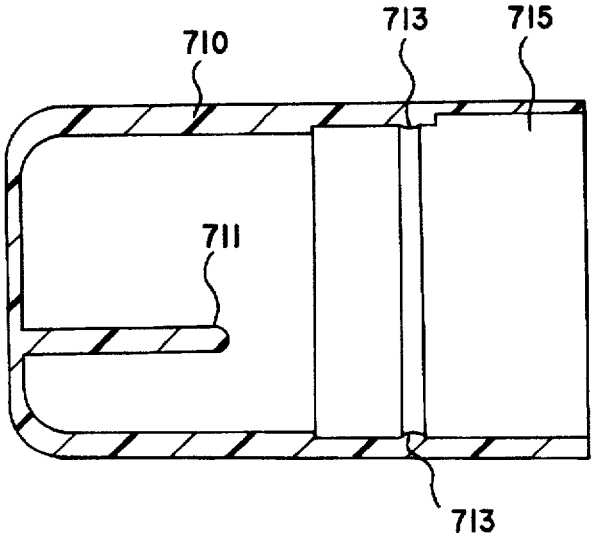
FIG. 17 is a vertical sectional view of the cap.
Figure 18:
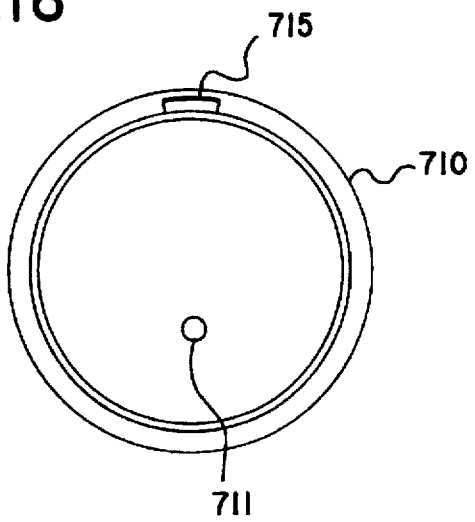
FIG. 18 is a side elevation of the cap.

FIG. 16 is a vertical sectional view of the principal portion of the applicator while in use of the seventh embodiment according to the present invention; FIG. 17 is a vertical sectional view of the cap 710; and FIG. 18 is a side elevation of the cap 710. In the figures, similar numerals are accorded to similar members which are common to the sixth embodiment.

In the seventh embodiment, valve body 705 is made spherical while cap 710 is formed inside thereof with valve operating rod 711 to press valve body 705.

Regarding the relationship of cap 710 with container 701, cap 710 is formed with protuberance 713 which engages intermediate shaft member 702 by overriding protuberance 712 formed around the periphery of the intermediate shaft member 702.

Further, part of the outside periphery of container 701 is formed with axially elongated projection 714, which engages recess 715 formed in the inside wall of cap 710 in correspondence with said projection 714 so as to align the valve operating rod 711 with the position of valve body 705 (or communication passage 703*a*) at the time of attaching cap 710 onto container body 701.

In the seventh embodiment, cap 710 is attached to container 701 with said groove 715 and projection 714 in alignment with each other such that valve operating rod 711 presses rod portion 705*b* of valve body 705 to push back valve body 705 blocking communication passage 703*a* against resilient body 706. Eventually, valve body 705 is pressed against the tip end of hollow shaft 702*b* with the result that the fluid flowing in from hollow shaft 702*b* to the sealed chamber 704 is blocked.

When cap 710 is removed from the tip end of container 701 to use the applicator, member 707 the pressing of valve body 705 by means of valve operating rod 716 is removed as shown in FIG. 16. In this situation, valve body 705 is pressed by resilient member 706 against shouldered seal portion 703*b* formed in communication passage 703*a* of the forward shaft member 703 to separate sealed chamber 704 from outside thereof.

As a result, the leak of the fluid from sealed chamber 704 from container 701 is further led through connecting passage 703*c* to counter-bored portion 708*a* in applicator attachment hole 708.

Therefore, pressing of applicator member 707 onto the desired object surface by gripping container 701 is applied thereto. Moreover, continuous application work is possible by gripping container 701.

Figure 19:
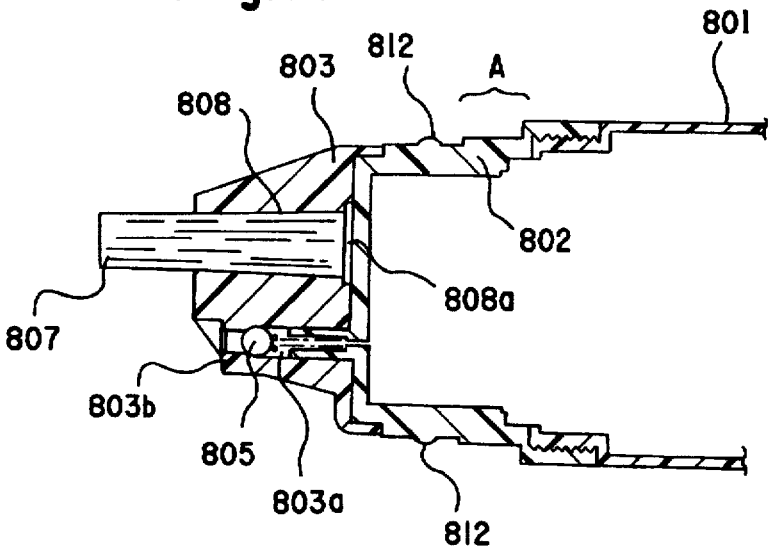
FIG. 19 is a vertical sectional view of the eighth embodiment of the liquid applicator according to the present invention when it is in use.
Figure 20:
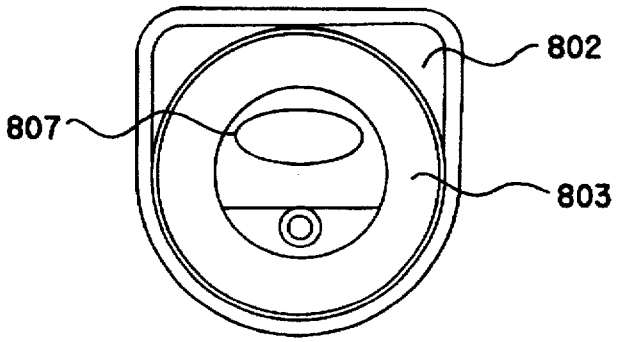
FIG. 20 is a side elevation of FIG. 19.
Figure 21:
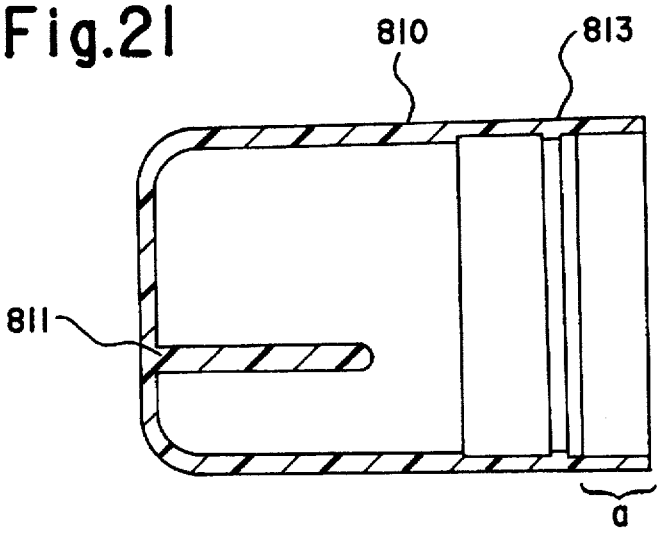
FIG. 21 is a vertical sectional view of the cap.
Figure 22:
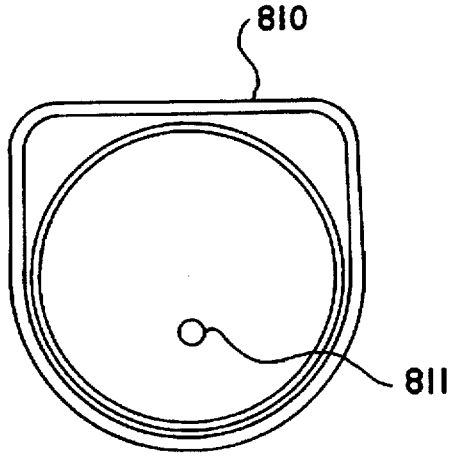
FIG. 22 is a side elevation of the cap.
Figure 25:
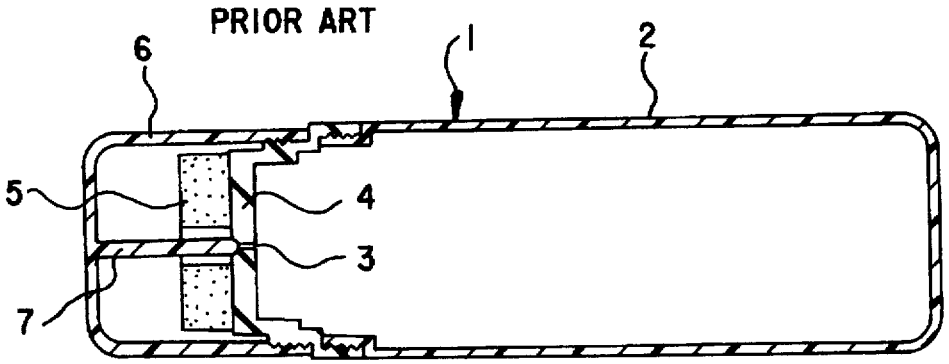
Fig.25 PRIOR ART
FIG. 25 is a vertical sectional view of the principal portion of the conventional shoe polish when it is not in use.

FIG. 19 is a vertical sectional view of the principal portion of the third embodiment of the fluid applicator according to the present invention while in use; FIG. 20 is a side elevation of FIG. 19; FIG. 21 is a vertical sectional view of the cap 310; and FIG. 22 is a side elevation of the cap 310.

In figures, similar numerals are accorded to similar members which are common to those of the sixth embodiment.

The eighth embodiment uses valve body 805 in spherical configuration as in the seventh embodiment and valve operating rod 811 attached to cap 810 to press the valve body 805.

Regarding the relationship of cap 810 with container 801, cap 810 is formed with protuberance 813 which engages intermediate shaft member 802 by overriding protuberance 812 formed around the periphery of the intermediate shaft member 802.

In the seventh embodiment, part of the outside periphery of cap 710 is formed with axially elongated projection 714 which engages groove 715 in the inside wall of cap 710 in correspondence with said projection 714 so as to align valve operating rod 716 with the position of valve 705. In the eighth embodiment, on the other hand, portion A of intermediate shaft member 802 which engages cap 810 is shaped rectangular in the upper portion thereof and circular in the lower portion thereof.

Further, as shown in FIG. 9, the shape of a of cap 810 corresponds to that of that portion A.

This assures that cap 810 can be attached onto intermediate shaft member 802 without holding the same upside down; that is, valve operating rod 811 can be inserted into communication passage 803*a* with ease such that valve body 805 which closes communication passage 803*a* is pushed back against the force by resilient member 806.

Then, valve body 805 is eventually pressed against the tip end of hollow shaft 802*b* to block the liquid flowing through hollow shaft 802*b* into the sealed chamber 804.

When cap 810 is removed from the tip end of container 801 to use the applicator, the pressing on valve body 805 by means of valve operating rod 811 of valve body 805 is removed. As a result, valve body 805 is pressed against shouldered seal portion 803*b* formed in communication passage 803*a* of forward shaft member 803 by means of resilient body 806 thereby separating seal chamber 804 and outside thereof.

Therefore, the liquid in seal chamber 804 is prevented from leaking outside while the liquid which has flown into sealed chamber 804 from container 801 is led through connecting passage 803*c* to counter-bored portion 808*a* of applicator attachment hole 808.

Therefore, pressing of applicator member 807 onto the desired object surface by gripping container 801 assures that the liquid which has soaked into applicator member 807 is applied thereto. Moreover, continuous application work is possible by gripping container 801.

Figure 3:
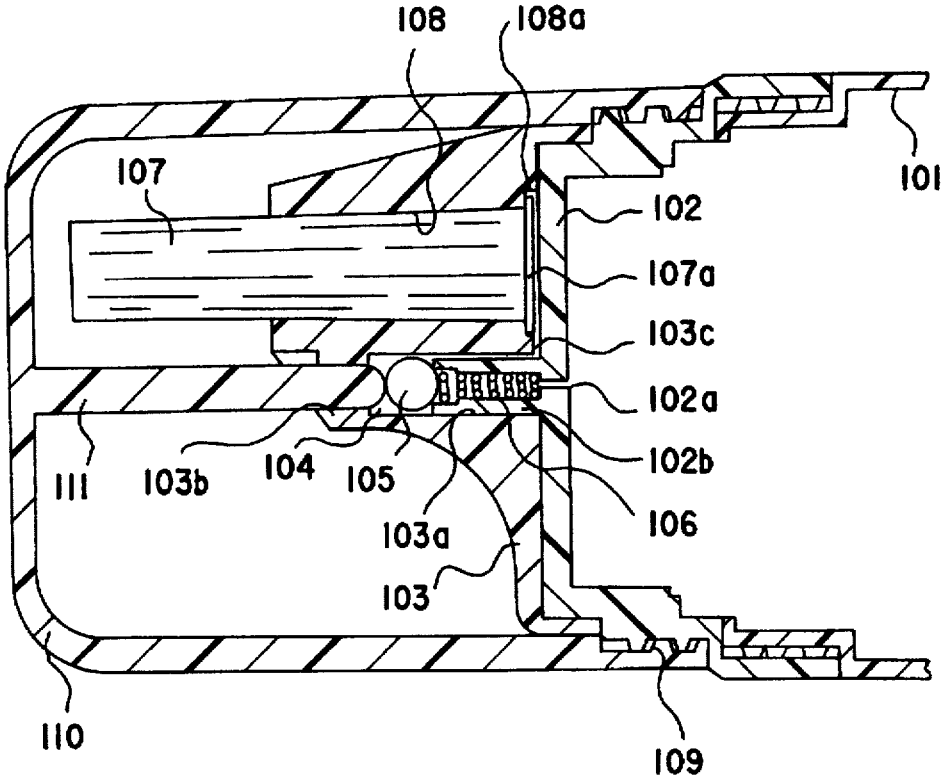
FIG. 3 is an enlarged view or the principal portion of FIG. 1.
Figure 4:
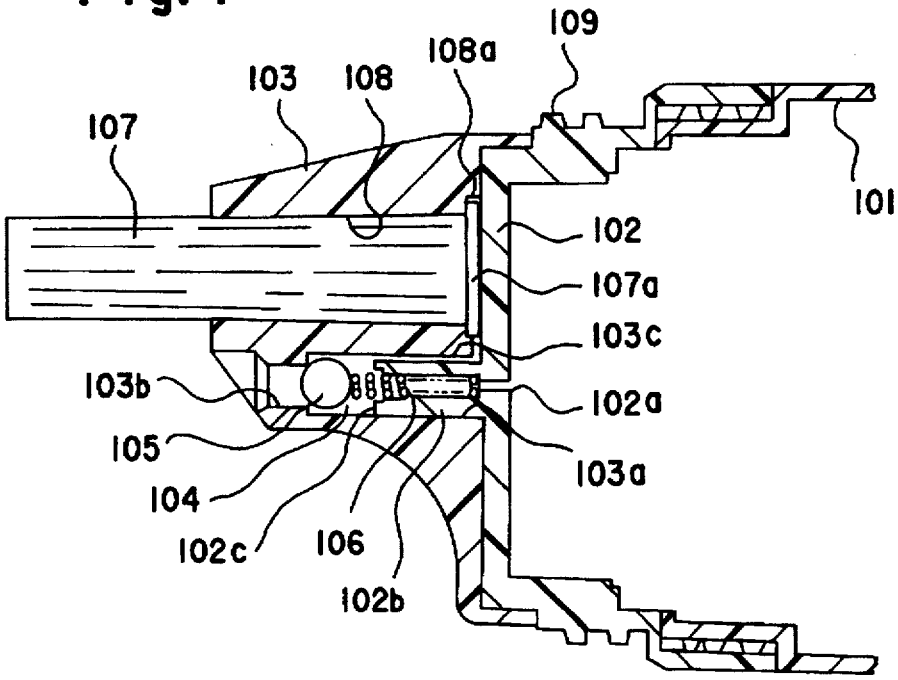
FIG. 4 is an enlarged view of the principal portion of FIG. 2.
Figure 23:
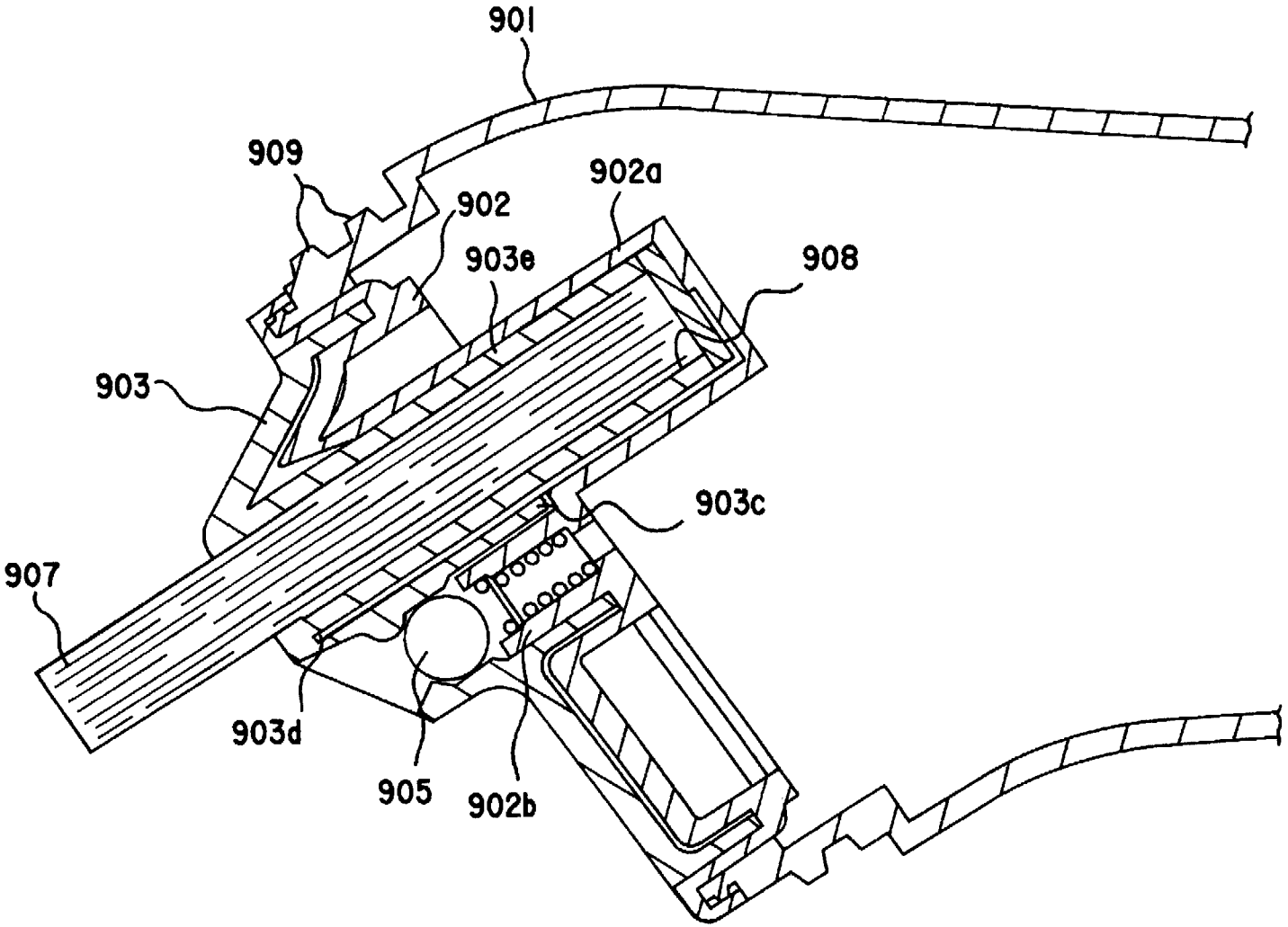
FIG. 23 is a vertical sectional view of the ninth embodiment of the liquid applicator according to the present invention when it is in use with the cap being removed.
Figure 24:
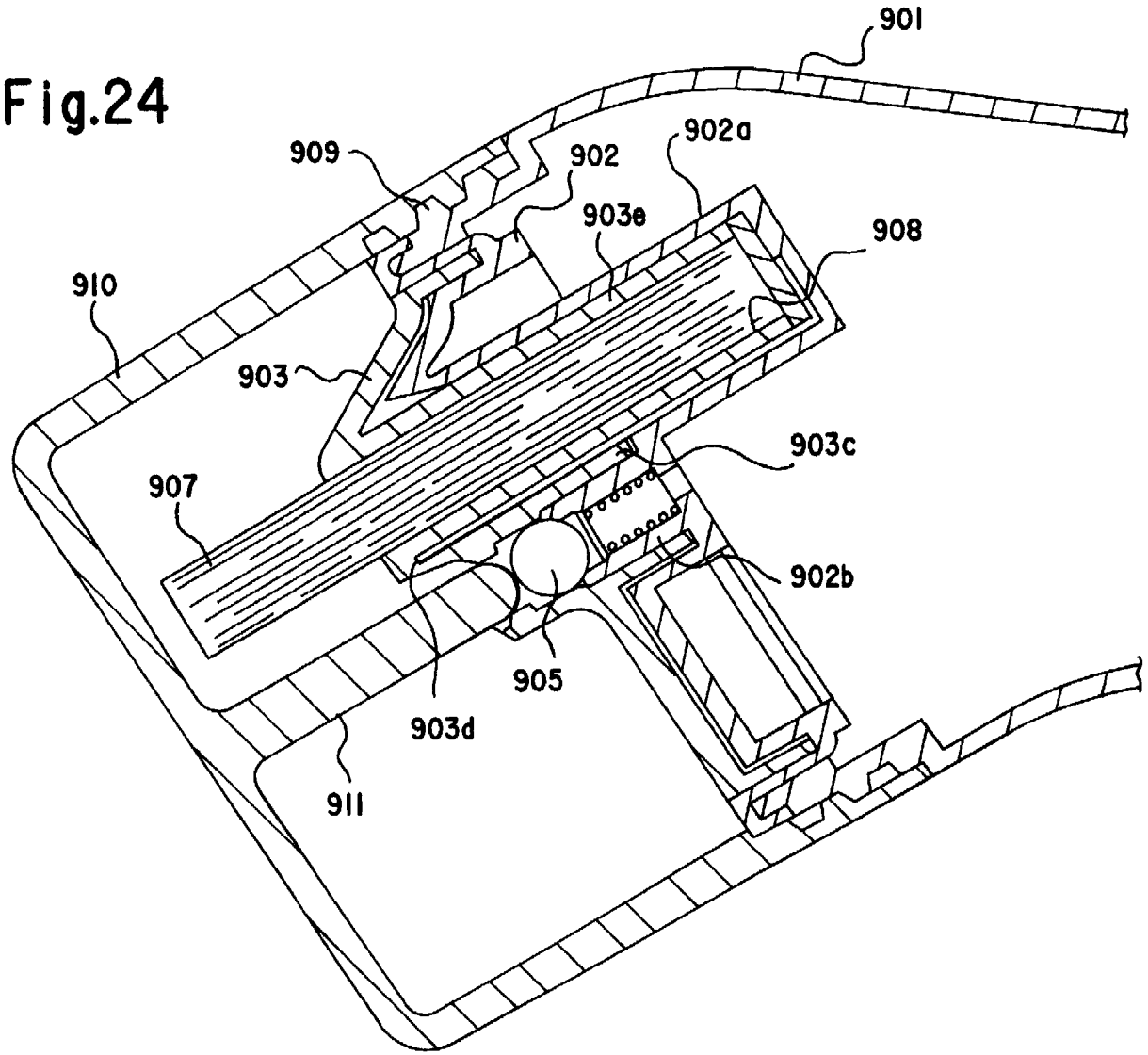
FIG. 24 is a vertical sectional view of the embodiment of FIG. 23 when it is not in use with the cap being attached.
Figure 26:
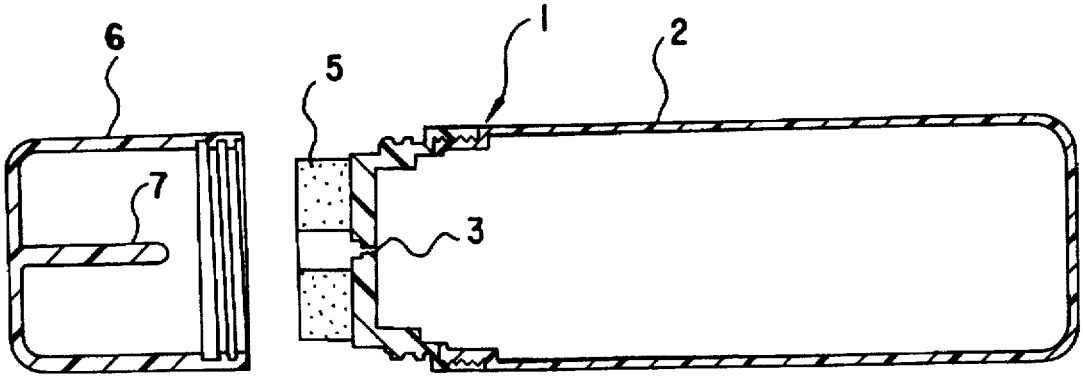
Fig.26 PRIOR ART
FIG. 26 is a vertical sectional view of the principal portion thereof in use with the cap being removed.

Referring to FIG. 23, the ninth embodiment is basically of the similar structure to that shown in FIG. 3. However, there is a modification in container 901, intermediate shaft member 902, the forward shaft member 903 and cap 910. Illustratively, intermediate shaft member 902 and forward shaft member 903 are sequentially fitted onto container 901. In this arrangement, cap 910 is screwed onto the tapped portion 909 formed on the forward periphery of container 901. Further, the intermediate shaft member 902 is formed with hollow portion 902*a* extending into container 901 at a position axially off center. On the other hand, forward shaft member 903 is formed with portion 903*e* which is fitted into the hollow portion 902*a* such that the portion 903*e* is formed with applicator member attachment hole 908. Along the portion 903*e*, connecting passage 903*c* extends forwardly to form pocket 903*d*.

The fluid applicator according to the present invention shall not be limited to the embodiments explained with reference to the drawings and permits various modifications combinations within the scope without departing from the subject matter of the invention with the fluid to be used being subject to selection as it suits the situation.

As explained in detail in the foregoing, the liquid applicator of the present invention is attached with a cap at the tip end thereof when not in use, in custody or during transit in which the valve body introduced in the sealed chamber is pressed by the pushing rod against the tip end of a hollow shaft such that the liquid is blocked to prevent from flowing into the sealed chamber with the result that accidental pressing of the container or any increase of inside pressure due to the rise of ambient temperature will not allow the fluid to leak outside.

While in use, the cap is removed from the tip end of the container to remove the pushing of the valve body by means of the valve pushing rod. This allows the valve body to be pressed by a resilient member against the shouldered seal portion formed in the communication passage in the forward shaft member. Then, the liquid in the sealed chamber is prevented from leaking outside while the liquid discharged from the container flows into the attachment hole through the communication passages. Therefore, the container is simply gripped and the applicator member is rubbed against the object surface such that the liquid which has soaked into the whole of the applicator member can be applied thereto while continuous application work is possible by pressing the container.

Further in accordance with the present invention, there is no need for directly pushing the forward applicator member into the whole of which the liquid has soaked as done in the prior art construction to operate the valve body while it is possible to sponge, felt, brushes etc. may be used in accordance with the class or viscosity of the liquid to be used.

Therefore, the liquid applicator according to the present invention allows the liquid in the container to be supplied through the sealed chamber to be applied directly to the object as in use whereas the cap is attached thereto to block the passage of the liquid not in use to assure the provision of a handy applicator regardless of the viscosity of the liquid.

As explained in the foregoing, the liquid applicator according to the present invention is constructed such that the cap is screwed on the tapped portion of the intermediate shaft member with the liquid applicator being inserted into a recess in the valve operating portion of the cap, while the valve operating portion constantly presses to block the communication of the liquid discharge vent and the communication passage. When the cap is removed, the liquid discharge vent and the communication passage are placed into communication with each other. Thus, the liquid is allowed to be led through the communication passage along the hollow shaft member to the applicator attachment hole to which the applicator is attached. Therefore, it is possible to arrange applicator attachment hole and the applicator centrally in the intermediate shaft member. As a result, the applicator which is easy to write with and handy is provided.

Further, the liquid applicator according to the present invention is constructed such that the protuberance formed in the intermediate shaft member or in the container body is engaged with the groove in the cap to position the cap such that the valve operating rod is pressed against the valve body to separate the liquid discharge vent and the communication passage. Therefore, it is possible to arrange the applicator attachment hole and the applicator centrally in intermediate shaft member like the applicator. As a result, the applicator which is easy to write with and handy is provided.

Further, the liquid applicator according to the present invention is constructed such that the inside surface of the cap and the periphery of the intermediate shaft member are asymmetrically shaped. Therefore, positioning done in attaching the cap to the tip end of the container body or the intermediate shaft member and that the valve operating rod is caused to press the valve body to separate the liquid discharge vent and the communication passage. Therefore, it is possible to arrange the applicator arrangement hole and the applicator centrally in the intermediate shaft member explained in the foregoing. As a result, the applicator which is easy to write with and handy is provided.

Further, the invention according to the present invention is constructed such that the cap is attached to the tip end of the container when the applicator is not in use, in custody or during transit to cause the valve body to separate the liquid discharge vent and the communication passage, thereby preventing the liquid from leaking outside even if the container is pressed. When the cap is removed from the tip end of the container, the pressing of the valve body by means of valve operating rod is removed to press the valve body against the shouldered seal portion in the communication passage in the forward shaft member to bring the liquid discharge vent and the communication passage in communication with each other. Therefore, the liquid which has flown into the sealed chamber is led through the communication passage to the applicator attachment hole. Therefore, the liquid which has soaked into the applicator member is applied to a desired object surface by gripping the container body.

Therefore, the liquid applicator according to the present invention will not open its liquid discharge vent directly to the outside. When the applicator is used, the liquid in the container body is supplied directly to the applicator member after the sealed chamber. While not in use, the cap is attached such that the passage for the liquid is blocked to assure that an excellent applicator is provided regardless of the liquid viscosity.

What is claimed is:

1. A liquid applicator comprising:

a container body made of a synthetic resin elastic material, said container body being charged with a predetermined liquid therein;

an intermediate shaft member hermetically attached to said container body at an open end thereof, said intermediate shaft member having a liquid discharge vent formed therein, said intermediate shaft member further having a hollow shaft member in communication with said liquid discharge vent and integrally projecting outwardly therefrom;

a forward shaft member press-fitted to said intermediate shaft member and having a communication passage into which said hollow shaft member is press-fitted, said communication passage having a shouldered seal portion at a forward end thereof to define a sealed chamber in cooperation with said hollow shaft member, said forward shaft member further having an applicator attachment hole which opens forwardly and a first connecting passage to provide communication between said first communication passage and said applicator attachment hole;

a valve body incorporated into said sealed chamber to be normally urged toward said shouldered seal portion to separate said sealed chamber from outside; and an applicator member securely inserted into said applicator attachment hole.

2. The liquid applicator according to claim 1, further including a cap adapted to be attached to any one of said container body and said intermediate shaft member, said cap having valve operating means to press said valve body against said hollow shaft member upon attachment of said cap thereon to prevent said liquid from flowing into said first connecting passage.

3. The liquid applicator according to claim 2, wherein said liquid discharge vent and said hollow shaft are centrally arranged, said applicator attachment hole being located off center.

4. The liquid applicator according to claim 3, wherein said valve operating means includes a valve operating rod which centrally extends from inside said cap to be inserted into said communication passage to operate said valve body.

5. The liquid applicator according to claim 3, wherein said applicator attachment hole has a counter-bored portion at a rearward end thereof.

6. The liquid applicator according to claim 5, wherein said counter-bored portion is extended to define a recess, said recess being fitted with a block plug having a second connecting passage therein which communicates with said first connecting passage in said forward shaft member, said applicator member having a liquid receiving hole therein which communicates with said second connecting passage.

7. The liquid applicator according to claim 5, wherein said counter-bored portion is extended to define a recess, said recess being fitted with a liquid absorber to maintain a high liquid retaining capability.

8. The liquid applicator according to claim 5, wherein said counter-bored portion is extended to define a recess, said recess being fitted with a block plug having a second connecting passage which communicates with said first connecting passage in said forward shaft member, said applicator member being made of a brush having a liquid receiving hole therein which communicates with said second connecting passage, said liquid receiving hole being fitted with a liquid absorbing member to maintain a high liquid retaining capability.

9. The liquid applicator according to claim 2, wherein said applicator attachment hole is centrally located, said liquid discharge vent and said hollow shaft being arranged off center.

10. The liquid applicator according to claim 9, wherein said valve operating means includes a ring-shaped valve operating portion fitted inside said cap and having a central recess therein to receive said applicator member, said valve body being composed of a spherical portion and a rod portion, said valve body normally urged forwardly such that said rod portion extends through and outside of said shouldered seal portion and a rearward end face of said ring-shaped valve operating portion presses against said rod portion of said valve body.

11. The liquid applicator according to claim 10, wherein any one of said intermediate shaft member and said container body has an axially elongated projection while said cap has a groove therewithin in correspondence with said axially elongated projection to provide positioning upon attachment of said cap to any one of said container body and said intermediate shaft member to press said spherical portion against said hollow shaft member.

12. The liquid applicator according to claim 10, wherein said intermediate shaft member has an asymmetric periphery, while said cap has an inside configuration complementary to said asymmetric periphery.

13. The liquid applicator according to claim 12, wherein said intermediate shaft member has a rectangular upper periphery and a semi-circular lower periphery.

* * * * *